US007230209B2

(12) United States Patent
Sterling

(10) Patent No.: US 7,230,209 B2
(45) Date of Patent: Jun. 12, 2007

(54) DUAL VOLTAGE INFINITE TEMPERATURE CONTROL FOR AN ELECTRIC COOKING APPLIANCE

(75) Inventor: Margaret M. Sterling, Madison, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 11/113,967

(22) Filed: Apr. 26, 2005

(65) Prior Publication Data

US 2006/0237434 A1 Oct. 26, 2006

(51) Int. Cl.
*H05B 3/68* (2006.01)
*H05B 3/02* (2006.01)

(52) U.S. Cl. ..... 219/462.1; 219/482

(58) Field of Classification Search ..... 219/443.1, 219/445.1, 446.1, 447.1, 448.11, 448.12, 219/476–483

See application file for complete search history.

(56) References Cited

U.S. PATENT DOCUMENTS

| | | | | |
|---|---|---|---|---|
| 2,761,051 | A | 8/1956 | Dodson | |
| 2,798,929 | A * | 7/1957 | Wojcik | 219/486 |
| 2,804,531 | A | 8/1957 | Dadson | |
| 2,870,313 | A * | 1/1959 | McCormick | 219/448.15 |
| 2,906,845 | A | 9/1959 | Turner | |
| 3,172,997 | A | 3/1965 | Wetzel et al. | |
| 3,374,336 | A | 3/1968 | Jacobs | |
| 3,403,244 | A | 9/1968 | Siegla | |
| 3,406,278 | A | 10/1968 | Bassett, Jr. et al. | |
| 4,371,780 | A | 2/1983 | Gossler et al. | |
| 4,511,789 | A | 4/1985 | Goessler et al. | |
| 4,634,843 | A | 1/1987 | Payne | |
| 4,973,933 | A | 11/1990 | Kadlubowski | |
| 5,171,973 | A | 12/1992 | Higgins | |
| 5,908,571 | A | 6/1999 | Scott | |
| 6,111,231 | A | 8/2000 | Corson et al. | |
| 2002/0158617 | A1 | 10/2002 | Garris, III | |

* cited by examiner

*Primary Examiner*—S. Paik
(74) *Attorney, Agent, or Firm*—Diederiks & Whitelaw PLC

(57) ABSTRACT

A cooking appliance includes a cooktop having a heating zone including an associated heating element, as well as a control element for setting a desired cooking temperature for the heating zone. When the control element is rotated from a home position across a temperature adjustment zone in a first direction, the heating element is operated at a low voltage setting and, when the control element is rotated from the home position in a second direction, the heating element is operated at a second, higher voltage setting. The control element includes a rotary shaft coupled to a voltage selector and an infinite control switch. With this arrangement, a consumer can cook delicate food items at infinitely adjustable low power cooking settings, as well as cook at a substantially infinite number of higher power settings, through the use of a single control element.

19 Claims, 2 Drawing Sheets

DUAL VOLTAGE INFINITE TEMPERATURE CONTROL FOR AN ELECTRIC COOKING APPLIANCE

BACKGROUND OF THE INVENTION

1. Field of the Invention

The present invention pertains to the art of cooking appliances and, more particularly, to a control element for a cooking appliance that selectively supplies power to a heating element at first and second voltage levels, said power being infinitely adjustable across a temperature selection zone.

2. Discussion of the Prior Art

Infinite temperature controls for controlling heating elements or zones arranged on cooktops of cooking appliances are known. Typically, a element or knob is rotated from an "off" position to a location across a temperature selection zone to establish a desired operating temperature for a heating element. The operating temperature can range from a low setting, typically positioned in a beginning portion of the rotation of the control knob, to a maximum setting, typically positioned adjacent an end portion of the rotation of the control knob. That is, the control knob provides infinite adjustment over an operational finite range so that the control knob actually rotates over a range of less than 360°.

In other arrangements, a control knob can actually rotate more than 360°. The control knob can either be rotated in a first direction to pass over the full temperature range, starting from a low setting and leading to a maximum setting, or the control knob can be rotated in a second direction to pass over the full temperature range, starting at the maximum setting and leading to the low setting. In many cases, the low setting is achieved by activating a single heating element, while the maximum setting is achieved by activating multiple heating elements.

In any event, an infinite switch typically includes a bimetal element coupled to a cycling contact and an internal heater. The internal heater causes the bimetal contact to deform when energy is applied to the internal heater and an internal resistive load. As the load and internal heater are heated, the bimetal contact deforms and the switch opens. When the switch opens, the bimetal contact cools and deforms back to its original, ambient position. At this point, a spring force causes the switch to close and the cycle can be repeated. In general, the infinite switch is employed in a 240 volt AC application and the internal heater is calibrated accordingly.

The cycling of the bimetal contact in a 240 volt system causes the heating element to exhibit significant instantaneous temperature changes. At medium and high temperature settings, these instantaneous temperature changes do not impact food items being heated to any significant degree. However, at lower temperature settings, the instantaneous temperature changes may cause adverse effects to certain food items. For example, melting chocolate and simmering sauces tend to burn even at the lowest temperature settings. To this end, such an infinite switch simply cannot establish the uniform low temperature required to melt or hold delicate food items.

In order to provide a greater degree of control at low temperatures, some manufacturers have proposed to activate the heating element with a lower supply voltage, such as 120 volts AC. The one-half reduction in voltage causes the heating element to operate at one-quarter the power. Operating at lower power enables the heating element to establish the uniform temperature required for cooking and/or holding delicate food items.

In order to achieve the voltage reduction, some manufacturers install a separate switch for toggling between high and low settings, while others provide a dual voltage infinite switch such as indicated at 2 in FIG. 1. Infinite switch 2 includes knob 4 that is rotated across an adjustment region 6 to establish a particular temperature for an associated heating element (not shown). The temperature adjustment region includes a first or low power portion 8 that operates the heating element at 120 volts AC and second or high power portion 10 that operates the heating element at 240 volts. While each of these arrangements provide good low temperature control, each arrangement possesses certain limitations. For instance, in the first example, either a separate toggle switch must be provided for each control or a single toggle can act as a master to all the controls. In the first case, the addition of multiple switches on the cooktop could detract from the overall aesthetics of the appliance, as well as increase the overall complexity of operation. In the second case, a master switch limits the flexibility of the controls. That is, when using a master switch, the consumer must either operate all of the heating elements in a high or low mode. In the second example, the dual voltage switch arrangement addresses this issue by incorporating the toggle switch into the control. While effective at eliminating clutter and the need for additional dedicated switches, the dual voltage infinite switch has a limited adjustment range. That is, only a small portion 8 of the overall adjustment region 6 is dedicated to the low setting.

Based on the above, there exists a need in the art for a control member for a cooking appliance that includes a voltage selector for activating a heating element with either a low voltage setting or a high voltage setting. More specifically, there exists a need for an integrated voltage selector/temperature control that provides a full adjustment zone for each of the low and high voltage settings.

SUMMARY OF THE INVENTION

The present invention is directed to a dual voltage, infinite temperature control for a cooktop of a cooking appliance. The cooktop includes at least one selectively controllable heating zone and an associated control element. More specifically, the heating zone includes at least one heating element, with the control element being associated with establishing a desired temperature level for the heating zone by selectively applying a voltage to the heating element.

In accordance with a preferred embodiment of the invention, the control element includes a home position and a temperature adjustment zone for establishing the desired cooking temperature for the heating zone. More specifically, rotation of the control element from the home position across the temperature adjustment zone in a first direction activates the heating element at a first voltage level, and rotation of the control element from the home position, across the temperature adjustment zone in a second direction activates the heating element at a second voltage level. In either case, the particular orientation of the control element relative to the temperature adjustment zone establishes a desired temperature of the heating element and, correspondingly, the heating zone.

In accordance with the most preferred embodiment of the present invention, the control element includes a rotary shaft that is coupled to a voltage selector and an infinite temperature control switch. With this arrangement, rotation of the control element causes the voltage selector to apply voltage at the infinite temperature control switch that corresponds to the directing of rotation. For example, the control element activates the heating element with 120 volts AC when rotated in the first direction and with 240 volts AC when rotated in the second direction. Preferably, the voltage selector and infinite temperature control switch are integrated into single unit that is mounted to the cooktop with the rotatable control element.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 2:
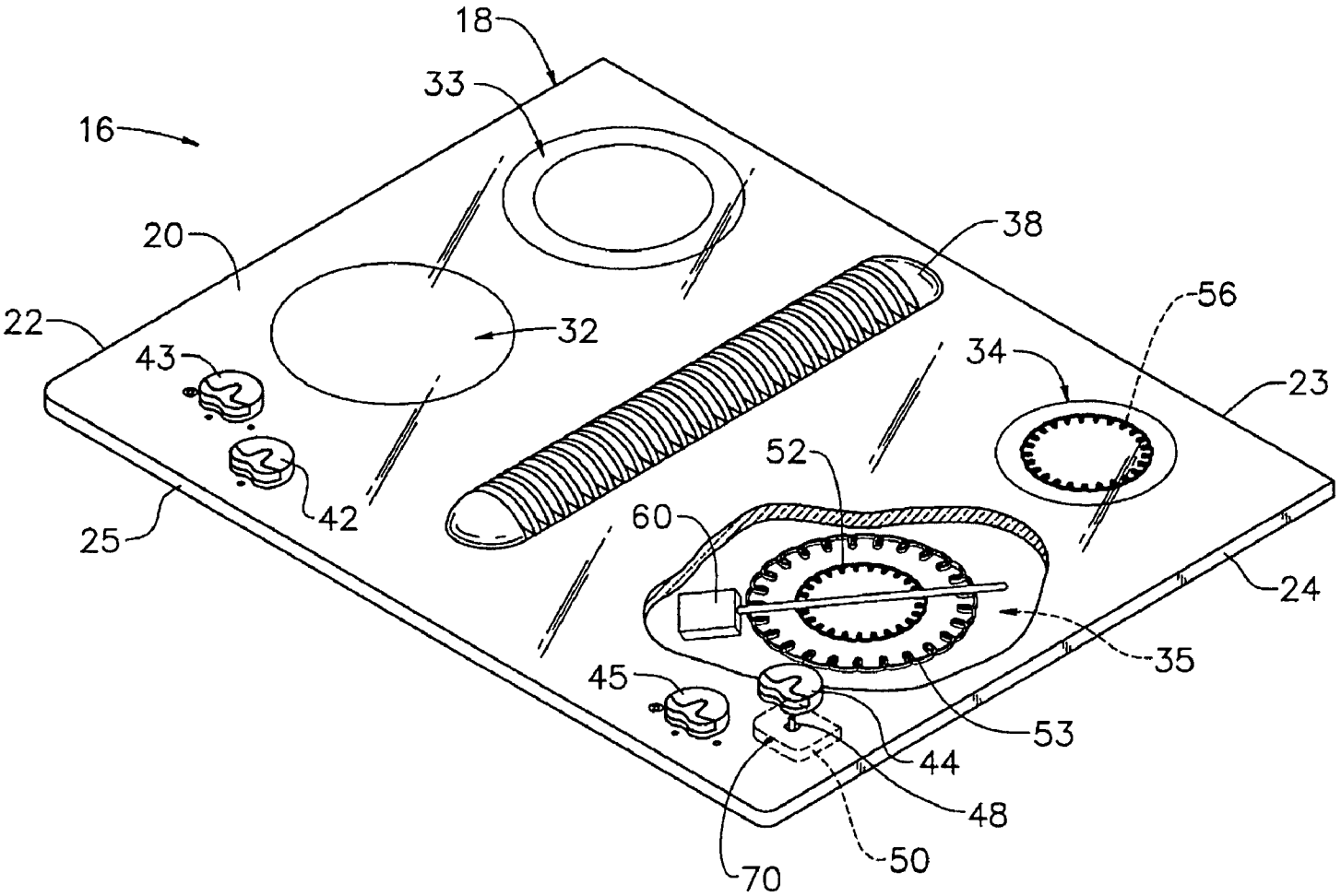
FIG. 2 is a perspective, partially cut-away view of a smooth surface cooktop employing a dual voltage infinite temperature control unit constructed in accordance with the present invention.

With initial reference to FIG. 2, a cooking appliance constructed in accordance with the present invention is generally shown at 16. Although the actual cooking appliance into which the present invention may be incorporated can vary, the invention is shown in connection with cooking appliance 16 depicted as a smooth surface cooktop 18. However, it should be understood that the present invention is not limited to this particular model type and can be incorporated into various types cooking appliances, including free standing ranges, slide-in ranges and the like. In the embodiment shown, cooktop 18 includes a top surface 20, defined by outer peripheral edge portions 22–25, having arranged there about a plurality of cooking zones 32–35.

In a manner known in the art, a downdraft fan unit 38 is shown centrally positioned upon top surface 20 between the plurality of cooking zones 32–35. In general, downdraft fan unit 38 is provided to remove smoke and/or other food effluents generated during a cooking process. As further shown in FIG. 2, cooking appliance 16 includes a plurality of control elements or knobs 42–45, each associated with a respective one of the plurality of cooking zones 32–35. Each control knob 42–45 is secured to a rotary shaft, such as indicated at 48, that extends from a control unit 50. As will be discussed more fully below, control knobs 42–45 establish particular temperature settings for each of the corresponding cooking zones 32–35.

In accordance with the embodiment shown, cooking zones 33 and 35 actually constitute dual element cooking zones, such that each zone 33 and 35 is provided with a first heating element 52 and a second heating element 53, while cooking zones 32 and 34 constitute single element cooking zones that are provided with respective single heating elements such as indicated at 56. In addition, each of cooking zones 32–35 is provided with a thermostat, such as indicated at 60, for controlling an operational temperature for the respective cooking zone 32–35. Since the operation of cooking zones 32 and 34 is identical, a description will be made with reference to cooking zone 34 and it is to be understood that cooking zone 32 is operated in a corresponding manner. In order to activate cooking zone 34, control knob 44 is rotatable in both a first or clockwise (CW) direction and a second or counterclockwise (CCW) direction. That is, in the preferred embodiment shown, rotating control knob 45 in a CCW direction will activate heating element 56 with a first voltage setting and rotating control knob 44 in a CW direction will activate heating element 56 with a second, higher voltage setting so as to establish a desired operating temperature for cooking zone 34. For the sake of completeness, the most preferred form of the invention utilizes a 1200 watt coil-type unit for heating element 56.

Figure 1:
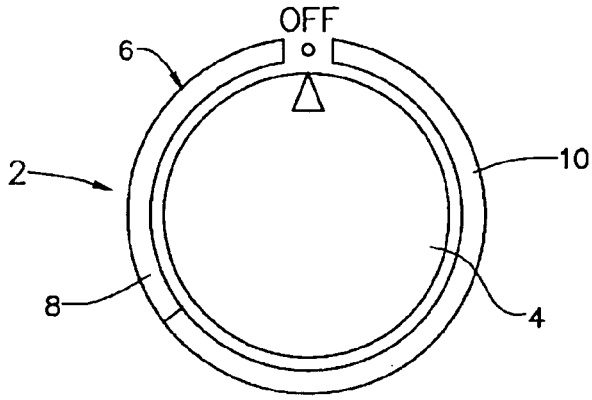
FIG. 1 (PRIOR ART)
FIG. 1 is a detail view of a control element for a cooking appliance constructed in accordance with the prior art.
Figure 3:
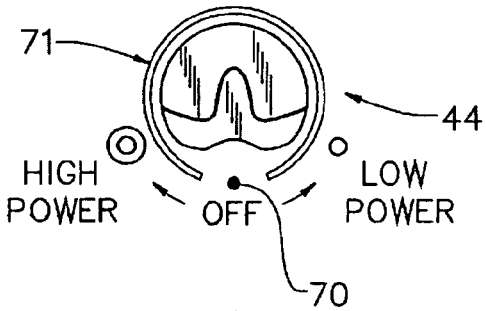
FIG. 3 is a detail view of the dual voltage infinite temperature control unit of FIG. 2.

As best seen in FIG. 3, control knob 44 includes a home or off position 70 and a temperature adjustment range or zone 71. When rotated in a CCW direction from home position 70, control knob 44 will initiate a low voltage mode and gradually increase the heat output of heating element 56 from an initial low setting to a maximum setting as control knob 44 rotates through temperature adjustment zone 71. In accordance with the most preferred embodiment of the present invention, the low voltage mode is constituted by operating heating element 56 with 120 volts AC. When it is desired to turn off or deactivate heating element 56, control knob 44 can either be rotated, CW, back through temperature adjustment zone 71 to home position 70 or, alternatively, rotated further CCW directly to home position 70. With this arrangement, heating element 56 is always activated at an initial low setting that is infinitely adjustable through a nearly 360° temperature adjustment range and may be deactivated by rotating control knob 44 in either direction.

In a similar manner, when rotated CW from home position 70, control knob 44 will initiate a high voltage mode and gradually increase the heat output of heating element 56 from an initial low setting to a maximum setting as control knob 44 rotates through temperature adjustment zone 71. In the most preferred form of the invention, the high voltage mode is constituted by activating heating element 56 with 240 volts AC. When it is desired to deactivate the high voltage mode, control knob 44 can be rotated in either direction to home position 70.

Thus, control knob 44 can be rotated nearly 360° to provide a wide range of infinitely variable heat settings for heating element 56. That is, if a consumer wishes to cook delicate food items such as sauces, the low voltage mode can be selected, with control unit 50 providing an infinitely adjustable temperature range and, if preparing standard food items, heating element 56 can be operated in the high voltage mode. Actually, as the low voltage mode (120 Volts) is one-half of the voltage used in the high voltage mode (240 volts), the power delivered by heating element 56 in the low voltage mode is one-quarter of that delivered in the high voltage mode. This power reduction allows for more delicate control to, for example, simmer delicate sauces, melt chocolate or to otherwise maintain a low temperature for a particular dish.

Figure 4:
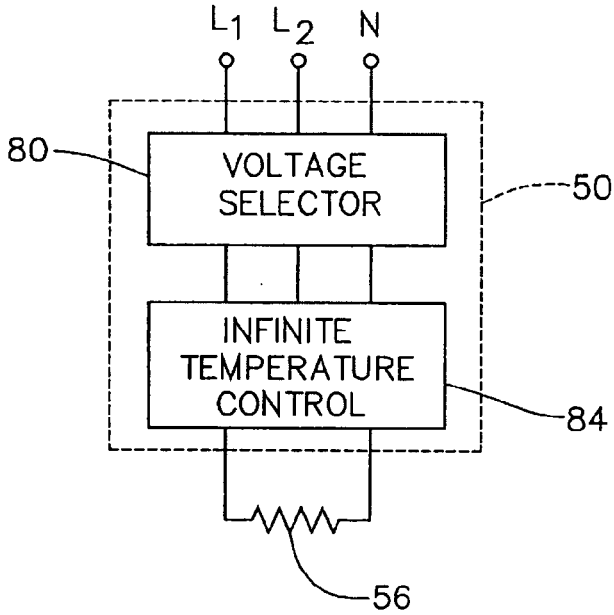
FIG. 4 is a block diagram of the control for the dual voltage infinite temperature control unit of FIG. 2.

In order to achieve the particular voltage mode selection and enable temperature control for heating element 56, control unit 50 includes a voltage selector portion 80 and an infinite temperature control portion 84 as best shown in FIG. 4. In further accordance with the preferred embodiment, voltage selector portion 80 and infinite temperature control portion 84 are operatively coupled to rotary shaft 48. As shown, voltage selector portion 80 includes inputs L1, L2 and N which are used to supply 120 volts AC and 240 volts AC to control unit 50. With this arrangement, operation of control knob 44 in either a CCW direction or a CW direction causes voltage selector portion 80 to send the corresponding voltage to infinite temperature control portion 84. Thereafter, control knob 44 can be rotated to operate infinite temperature control portion 84 to establish an extremely wide range of temperature settings for heating element 56. In this manner, the present invention allows for a large, essentially infinite adjustment range for setting a desired temperature for cooking zone 34 when activating heating element 56 in either a low voltage mode or a high voltage mode. If desired, an output from a respective thermostat 60 could be linked to a visual display to further enhance the setting of a desired cooking temperature.

Although described with reference to a preferred embodiment of the present invention, it should be readily apparent to one of ordinary skill in the art that various changes and/or modifications can be made to the invention without departing from the spirit thereof. For instance, while the present invention is described in connection with a single element cooking zone, dual or multiple element cooking zones could also be employed. In addition, the particular direction of rotation, i.e., counterclockwise or clockwise, described above is for exemplary purposes only. Furthermore, cooking appliance 2 could be provided with various LED's, colored graphics, alpha and/or numeric displays, or the like to indicate the particular operational or temperature status of the cooking zone. Finally, it should be realized that the particular type of control knob or element employed could greatly vary without departing from the invention. In general, the invention is only intended to be limited to the scope of the following claims.

I claim:

1. A cooking appliance comprising:

a cooktop;

a heating zone arranged on the cooktop, said heating zone including a heating element;

means for establishing first and second voltage levels for operation of the heating element, with the second voltage level being higher than the first voltage level; and a control element operatively connected to the heating element and movable from a home position through a temperature adjustment zone, wherein movement of the control element from the home position in a first direction activates the heating element with the first voltage level, and movement of the control element from the home position in a second direction activates the heating element with the second voltage level, said control element being movable through the entire temperature adjustment zone, while operating at a selected one of the first and second voltage levels, to regulate an amount of power supplied to the heating element in order to provide a wide range of temperature settings for the heating element in both the first and second directions.

2. The cooking appliance according to claim 1, wherein movement of the control element through the temperature adjustment zone in either the first or second direction back to the home position deactivates the heating element.

3. The cooking appliance according to claim 1, wherein the control element is rotatable through the temperature adjustment zone to set a desired heat level for the heating element.

4. The cooking appliance according to claim 3, wherein the control element is adapted to rotate in a clockwise direction to select the first voltage level and in a counterclockwise direction to select the second voltage level.

5. The cooking appliance according to claim 2, wherein the first voltage level is constituted by 120 Volts AC and the second voltage level is constituted by 240 Volts AC.

6. The cooking appliance according to claim 2, wherein the means for establishing the first and second voltage levels includes a voltage selector operatively coupled to the control element.

7. The cooking appliance according to claim 6, wherein the control element includes an infinite control switch.

8. The cooking appliance according to claim 7, wherein the voltage selector and infinite control switch are integrated into a unit which is mounted to the cooktop.

9. A cooking appliance comprising:

a cooktop;

a heating zone arranged on the cooktop, said heating zone including a heating element; and control means operatively connected to the heating element, said control means being adjustable from a home position through a temperature adjustment zone, wherein movement of the control means from the home position in a first direction activates the heating element with a first voltage level, and movement of the control means from the home position in a second direction activates the heating element with a second voltage level, said control means being movable through the entire temperature adjustment zone, while operating at a selected one of the first and second voltage levels, to regulate an amount of power supplied to the heating element in order to provide a wide range of temperature settings for the heating element in both the first and second directions.

10. The cooking appliance according to claim 9, wherein the control means is movable through the temperature adjustment zone in either the first or second direction back to the home position to deactivate the heating element.

11. The cooking appliance according to claim 9, wherein the control means includes a rotatable control element for setting a desired heat level for the heating element.

12. The cooking appliance according to claim 11, wherein the control means further includes a power selection means operatively coupled to the control element, said power selection means being adapted to selectively alter an amount of power supplied to the heating element as the control element is rotated within the temperature adjustment zone.

13. The cooking appliance according to claim 12, wherein the control means further includes a voltage selection means, said voltage selection means being adapted to pass one of the first and second voltage levels to the power selection means based upon a direction of rotation of the control element.

14. The cooking appliance according to claim 13, wherein the first voltage level is 120 Volts AC and the second voltage level is 240 Volts AC.

15. The cooking appliance according to claim 12, wherein the power selection means is constituted by an infinite control switch.

16. The cooking appliance according to claim 13, wherein the power selection means and the voltage selection means are integrated into a unit which is a mounted to the cooktop.

17. A method of selectively activating a heating element of a heating zone on a cooktop through manipulation of a control element comprising:

operating the heating element at a first voltage level by:

shifting the control element from a home position in a first direction to establish the first voltage level;

adjusting the control element to a desired operating position within a temperature adjustment zone to establish a desired operating setting from substantially infinitely variable temperature setting positions throughout the entire temperature adjustment zone, while operating at the first voltage level; and operating the heating element at a second voltage level, which is higher than the first voltage level, by:

shifting the control element from the home position in a second direction to establish the second voltage level; and adjusting the control element to a desired operating position within the temperature adjustment zone to establish a desired operating setting from substantially infinitely variable temperature setting positions throughout the entire temperature adjustment zone, while operating at the second voltage level.

18. The method of claim 17, wherein rotating the control element in a clockwise direction from the home position establishes operation of the heating element at the first voltage level and rotating the control element in a counter-clockwise direction from the home position establishes operation of the heating element at the second voltage level.

19. The method of claim 18, further comprising:

de-activating the heating element by rotating the control element through the temperature adjustment zone in either the first or second direction back to the home position.

* * * * *